US006175289B1

(12) United States Patent
Bellotto

(10) Patent No.: US 6,175,289 B1
(45) Date of Patent: Jan. 16, 2001

(54) ELECTRONIC TRIP DEVICE WITH A REMOVABLE VOLTAGE SWITCH MODULE

(75) Inventor: Henri Bellotto, Saint Martin d'Heres (FR)

(73) Assignee: Square D Company, Palatine, IL (US)

( * ) Notice: Under 35 U.S.C. 154(b), the term of this patent shall be extended for 0 days.

(21) Appl. No.: 09/493,205

(22) Filed: Jan. 28, 2000

(30) Foreign Application Priority Data

Mar. 2, 1999 (FR) ..... 99 02838

(51) Int. Cl.[7] ..... H01H 9/02
(52) U.S. Cl. ..... 335/202; 335/18; 335/132
(58) Field of Search ..... 335/18, 6–10, 335/202, 132; 700/293–308; 361/42–51

(56) References Cited

U.S. PATENT DOCUMENTS 4,181,906 1/1980 Matsko et al. .
5,264,811 * 11/1993 Takeda ..... 335/18
5,450,048 * 9/1995 Leger et al. ..... 335/132

FOREIGN PATENT DOCUMENTS 298 14 467 U 11/1998 (DE) .
0320409 6/1989 (EP) .
0611224 8/1994 (EP) .

* cited by examiner

*Primary Examiner*—Lincoln Donovan
(74) *Attorney, Agent, or Firm*—Parkhurst & Wendel, LLP

(57) ABSTRACT

A trip device comprises a removable module for determining long delay tripping parameters, designed to be fixed to a front panel of the trip device. In the fixed position, the removable module exerts a pressure, via an auxiliary part, on a movable part so as to move the latter to a position in which it performs voltage connection of the processing circuit of the trip device to the conductors of a power system to be protected. In an unlocked position of the removable module, the movable part is urged to the disconnected position by a spring. The part can be movable in rotation or in translation.

9 Claims, 10 Drawing Sheets

ELECTRONIC TRIP DEVICE WITH A REMOVABLE VOLTAGE SWITCH MODULE

BACKGROUND OF THE INVENTION

The invention relates to an electronic trip device comprising a case, an electronic processing circuit located inside the case, connection means for connecting the processing circuit to conductors of a power system to be protected, means for determining tripping parameters comprising a removable module, means for fixing the removable module on a front panel of the case, the removable module coming into contact, in the fixed position, with the processing circuit. The use of a removable module for determining long delay protection parameters is conventional in electronic trip devices. Some trip devices comprise a processing circuit directly connected to conductors of a power system to be protected, so as to enable voltage measurement, for example by means of a resistive dividing bridge. This direct connection, without a transformer, must be able to be interrupted, in particular to carry out dielectric isolation tests. In certain protection apparatuses a removable device is provided located on the front panel which, when it is removed, interrupts the voltage connection.

SUMMARY OF THE INVENTION

The object of the invention is to achieve a trip device in which these two functions are performed in simple and dependable manner.

According to the invention, this object is achieved by the fact that the connection means comprise, inside the case, a movable part movable between a connected position and a disconnected position and comprising flexible contacts achieving, in the connected position, a contact between first contact points of a printed circuit, connected to the power system conductors, and second contact points of the printed circuit forming voltage inputs of the processing circuit, the connection means comprising spring means urging the movable part to the disconnected position, the removable module, in the fixed position, urging the movable part to the connected position against the action of the spring means. Said part can be movable in rotation or in translation.

According to a first development of the invention the part is movable in rotation and comprises rotation pins having an end of rectangular cross-section, internal faces of side walls of the case comprising associated guide elements each bounding a narrow rectangular passage and a circular space.

According to another development of the invention the case comprises a guide rib on an internal face of at least one side wall of the case, the removable module comprising lateral lugs coming into contact with one end of an auxiliary part, the auxiliary part being in contact with the movable part and guided by the guide rib.

According to another development of the invention the processing circuit comprises at least a first printed circuit board, located in the case near to the front panel and comprising terminals designed to come into contact with associated contacts of the removable module, and a second printed circuit board, located in a laid back position with respect to the front panel and comprising the first and second contact points, the movable part being interposed between the second printed circuit board and the front panel.

BRIEF DESCRIPTION OF THE DRAWINGS

Other advantages and features will become more clearly apparent from the following description of particular embodiments, given as non-restrictive examples only, and represented in the accompanying drawings in which.

DETAILED DESCRIPTION OF THE PREFERRED EMBODIMENT

Figure 1:
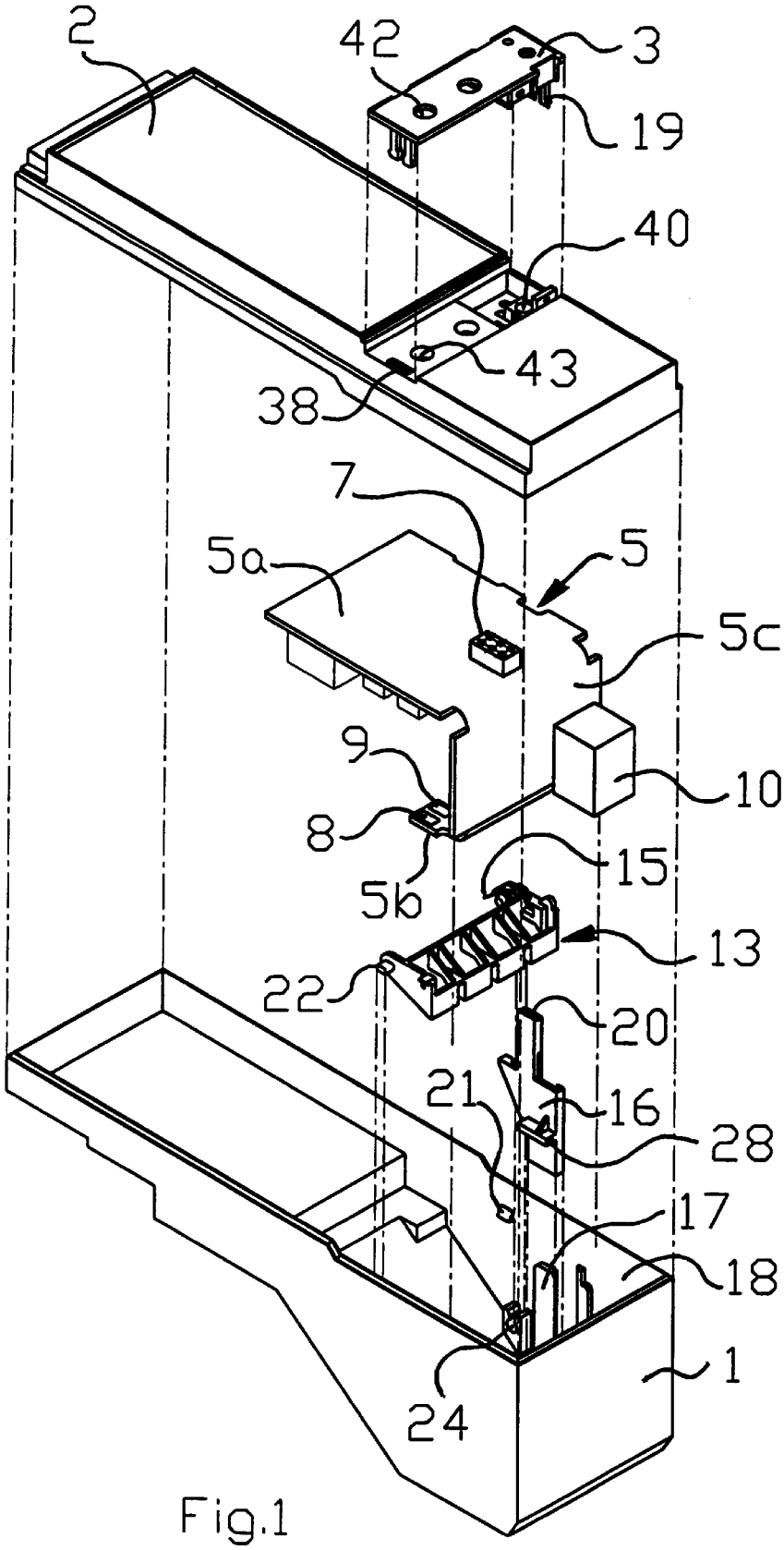
FIG. 1 represents a particular embodiment of a trip device according to the invention, in an exploded view.

The trip device represented in FIG. 1 comprises a case 1 equipped with a front panel 2, forming part of a cover of the case and accessible to the user. In known manner, a removable module 3 is designed to be fixed onto the front panel of the case. It enables the long delay protection parameters to be determined, generally in conjunction with setting devices, not represented in FIG. 1, formed for example by potentiometers, selector switches or keys located on the front panel.

Figure 2:
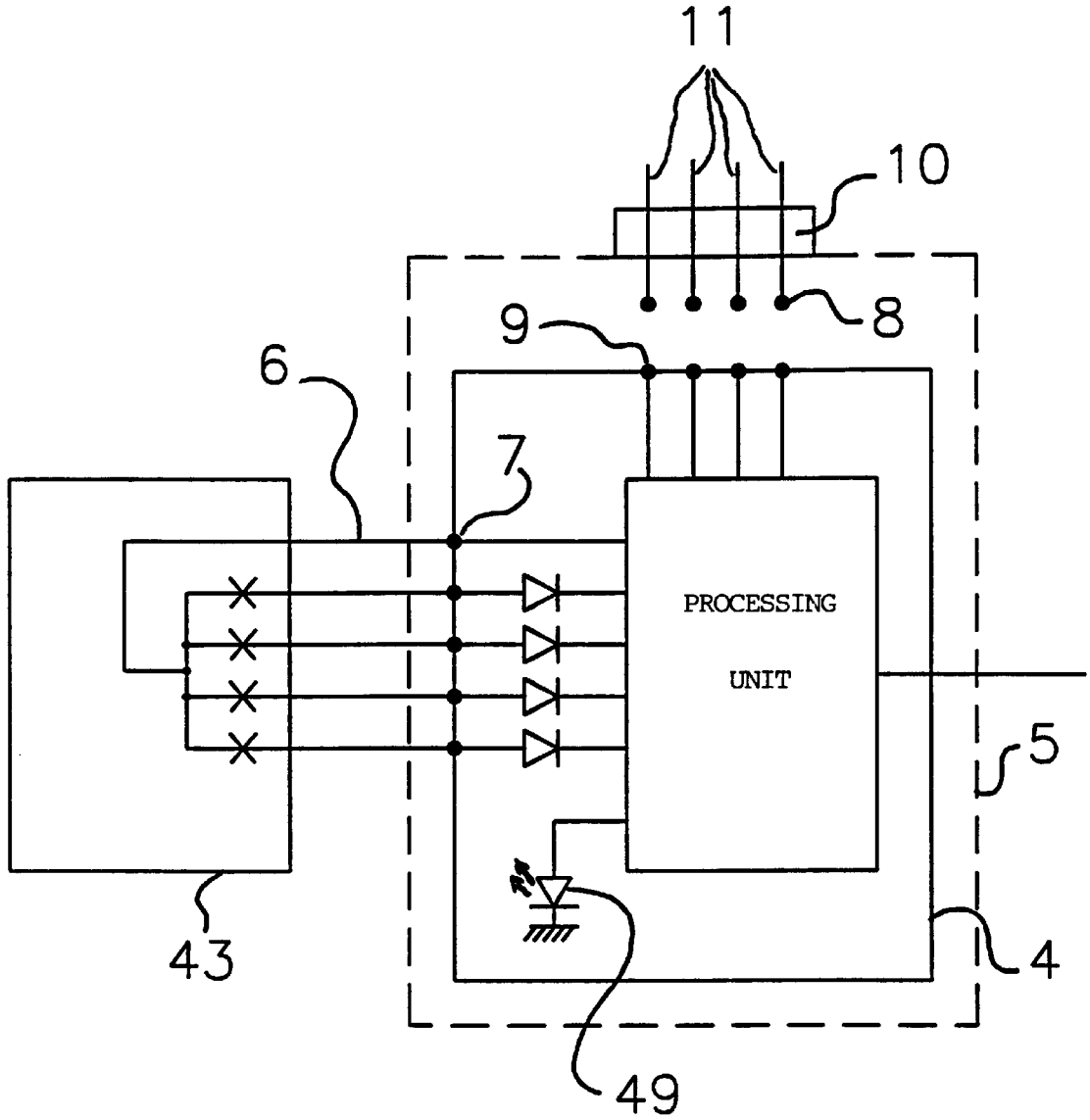
FIG. 2 schematically represents the electrical connections between various elements of the trip device according to the invention.

The removable module 3 also operates in conjunction with a processing circuit 4 (FIG. 2) supported by a printed circuit 5. In FIG. 1, the printed circuit 5 is formed by three printed circuit boards 5*a*, 5*b*, 5*c* connected by flexible parts. The board 5*a* is arranged near to the front panel 2 so that, in the fixed position of the removable module on the trip device, contacts 6 of the removable module 3 (FIGS. 2 and 13) come into contact with associated parts of the printed circuit constituting terminals 7 of the processing circuit (FIG. 2). The board 5*a* is appreciably parallel to the front panel 2. The board 5*b* is located laid back with respect to the front panel, near to the bottom of the case 1. Board 5*b* is appreciably parallel to board 5*a* and comprises first and second contact points 8 and 9 on its upper face. In a preferred embodiment, the board 5*b* comprises four pairs of contact points. The first contact point 8 of each pair is connected, by means of the printed circuit and of a connector 10, to a conductor 11 of a power system to be protected (FIG. 2). In the particular embodiment represented in FIG. 1, the connector 10 is mounted on the board 5*c*, located in an intermediate position between the boards 5*a* and 5*b*, appreciably perpendicularly to the front panel 2 of the trip device.

Figure 3:
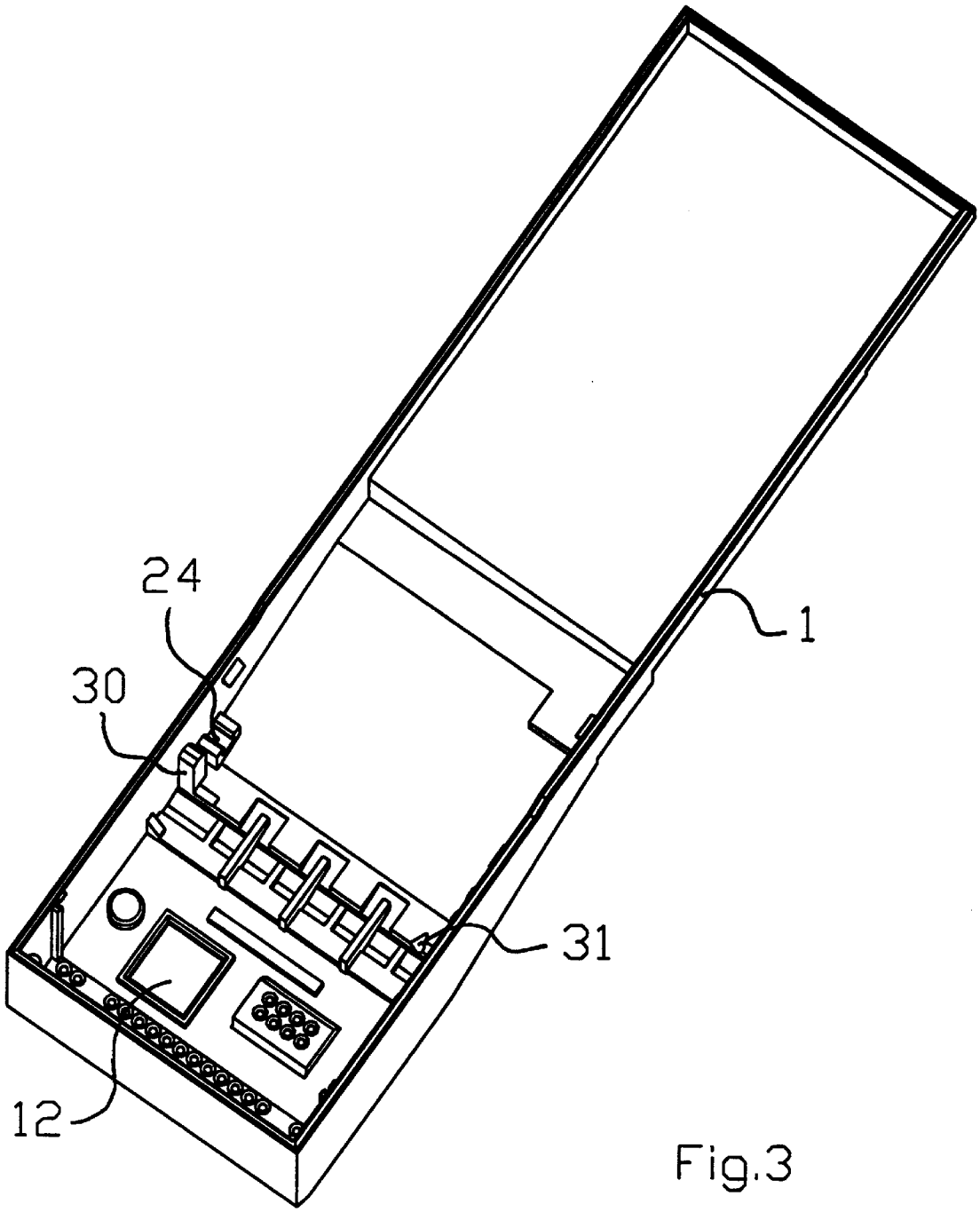
FIG. 3 represents the base of the case of the trip device according to FIG. 1.

The connector 10 is connected to the power system conductors 11 via an orifice 12 arranged in the back plate of the case 1 (FIG. 3). The second contact points 9 form the voltage inputs of the processing circuit 4.

The trip device comprises a movable part 13 movable between a connected position and a disconnected position. The movable part 13 comprises flexible contacts 14 (FIGS. 5 and 6) designed to achieve, in the connected position, a contact between the first contact points 8 and the second contact points 9, thus enabling the processing circuit 4 to perform measurement of the power system voltage.

Figure 4:
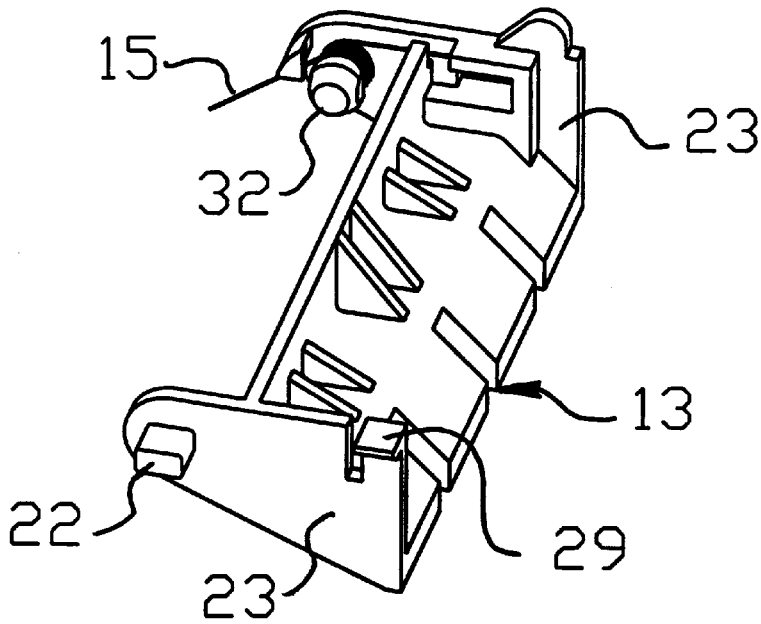
FIGS. 4 and 5 represent, respectively in top view and bottom view, the movable part of the trip device according to FIG. 1.
Figure 7:
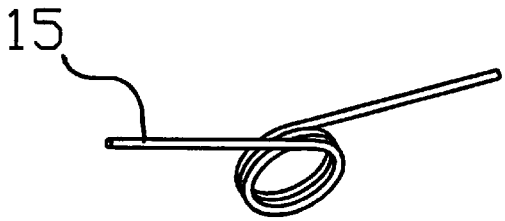

The part 13 is normally urged to the disconnected position by spring means formed, in the preferred embodiment represented in FIGS. 1, 4 and 7, by a torsion spring 15. The removable module 3, when it is in the fixed position on the front panel 2 of the case 1, urges the movable part 13 to the connected position against the action of the torsion spring 15.

Figure 8:
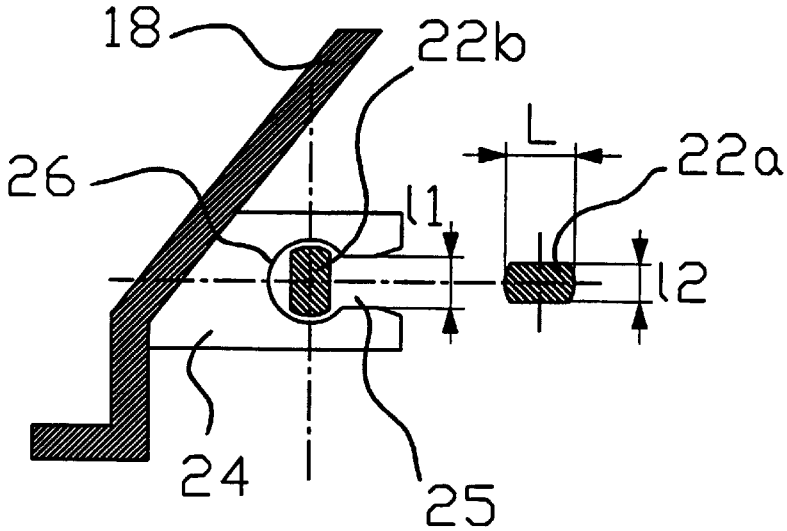
FIG. 8 illustrates two positions of a rotation pin of the movable part according to FIGS. 4 and 5 with respect to associated guide elements of the case.
Figure 9:
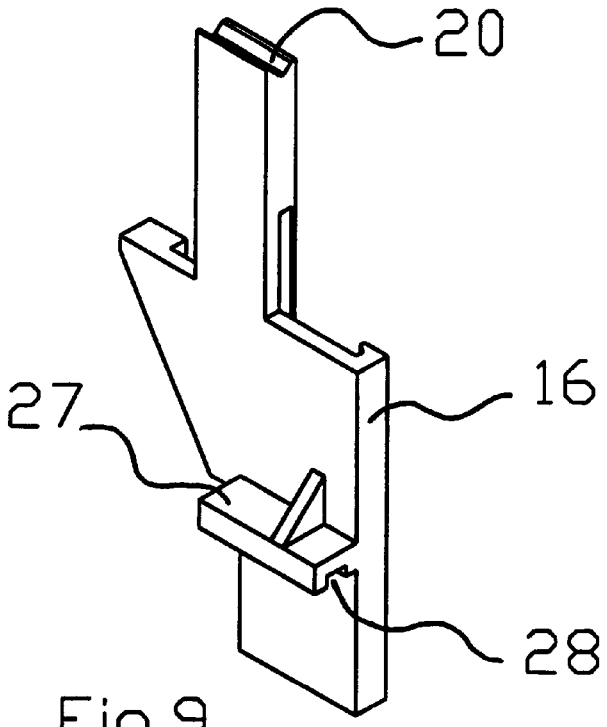
FIGS. 9 and 10 represent the auxiliary part of the trip device of FIG. 1, respectively in front view and rear view.
Figure 10:
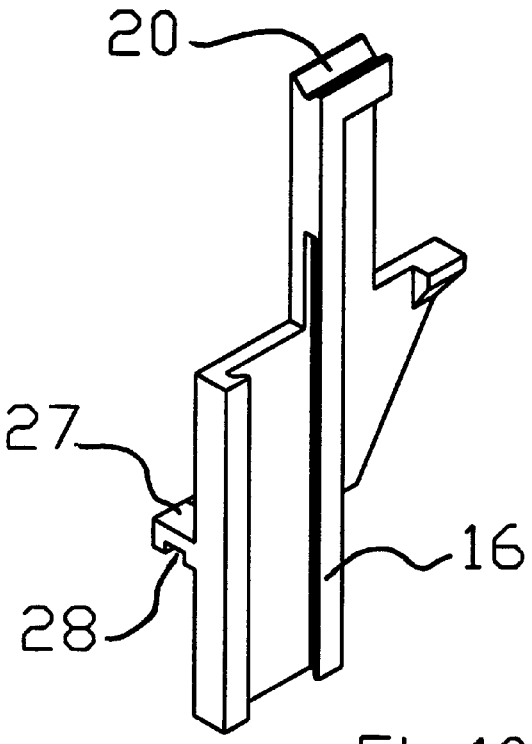
Figure 11:
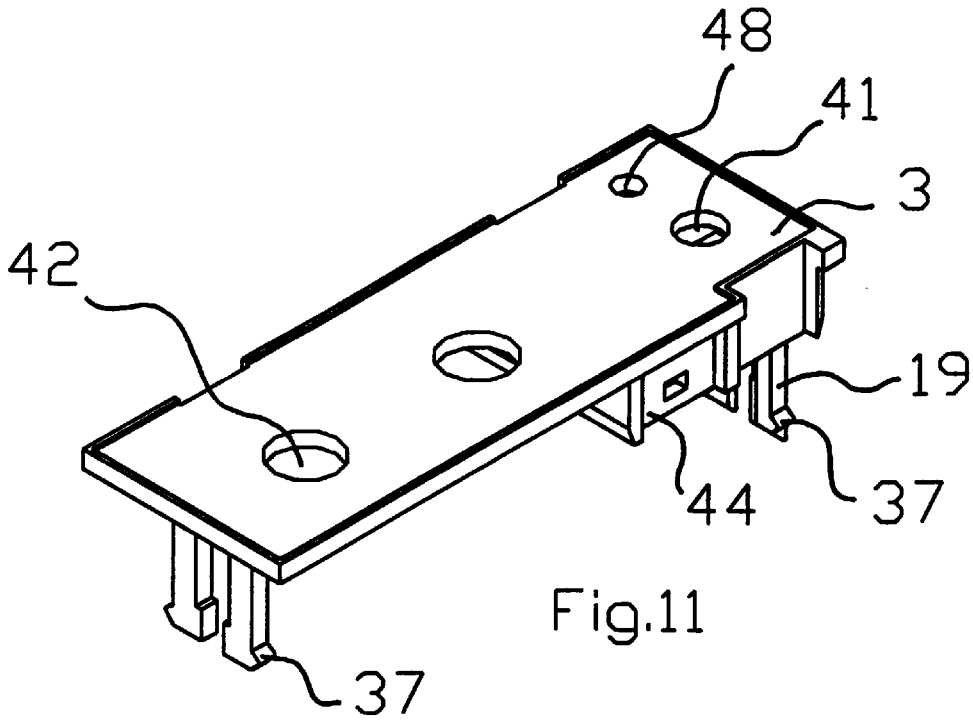
FIGS. 11 and 12 respectively represent in top view and bottom view, the module of the trip device according to FIG. 1.
Figure 12:
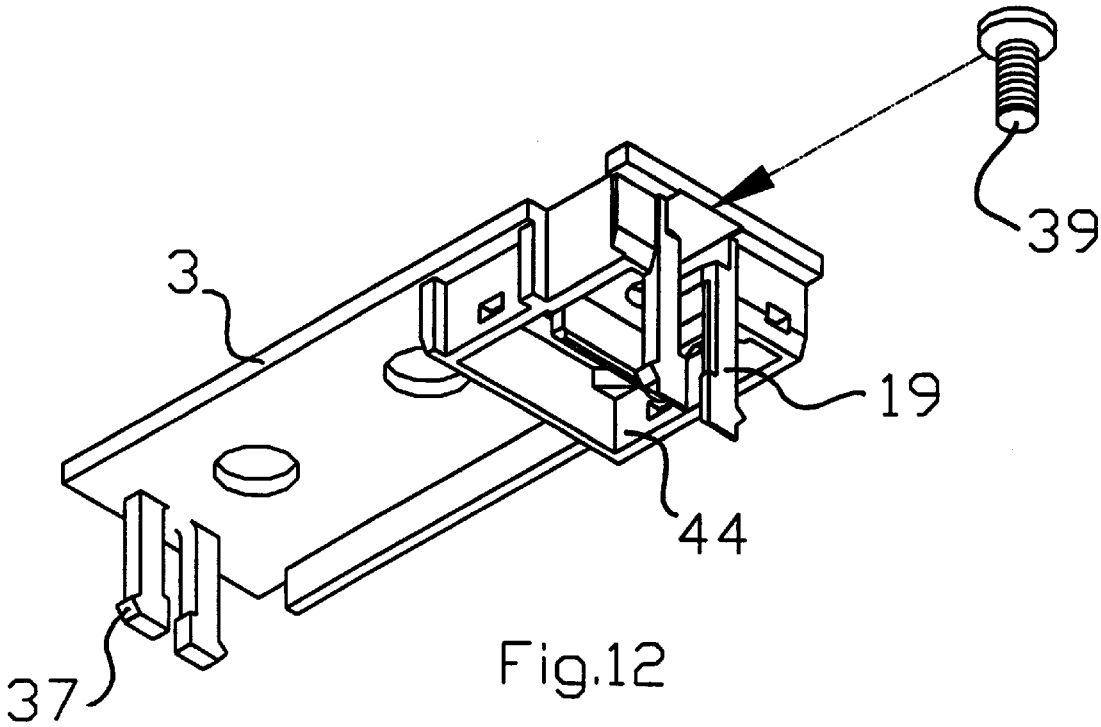

An auxiliary part 16 is preferably inserted between the removable module 3 and the movable part 13. The auxiliary part 16 (FIGS. 1, 9 and 10) is guided by a guide rib 17 (FIG. 1) formed on an internal face 18 of a side wall of the case 1. It can move along the guide rib 17, vertically in FIG. 1, between first and second positions. In the first position, the removable module 3, in the fixed position, is in contact, via at least one lateral lug 19, with an end 20 of the auxiliary part 16. The auxiliary part, in contact with the movable part 13, holds the latter in its connected position. When the removable module 3 is not fixed to the front panel 2 of the trip device, it does not exert sufficient pressure on the movable part 13, via the auxiliary part 16, to keep it in the connected position. The movable part is then urged to the disconnected position by the torsion spring 15 and urges the auxiliary part 16 to its second position, upwards in FIG. 1. The upward movement of the auxiliary part 16 is preferably limited by a stop pin 21 arranged on the internal face 18. In a preferred embodiment, the part 13 is movable in rotation. It comprises two rotation pins 22 (FIGS. 1, 4 and 5) securedly affixed to side flanges 23 and protruding outwards. The rotation pins 22 preferably have an end of rectangular cross-section designed to operate in conjunction with guide elements 24 (FIGS. 1 and 8) securedly affixed to the internal faces 18 of the side walls of the case. Each guide element 24 bounds a narrow rectangular passage 25, on one of the faces 18, opening out into a circular space 26. FIG. 8 represents a rotation pin 22 in two different positions with respect to the corresponding guide element 24. In a first position the pin 22*a* is ready to be inserted in the guide element. Its orientation is such that it can be inserted in the rectangular passage 25 whose width 11 is slightly greater than the width 12 of the cross-section of the end of the pin and smaller than the length L of this cross-section. The circular space 26 has a diameter slightly greater than the length L. Thus, when the pin is in the second position (pin 22*b* in FIG. 8) inside the circular space 26, after passing through the passage 25, it can rotate freely.

In a particular embodiment (FIGS. 9 and 10), the auxiliary part 16 comprises a protruding part 27 provided on its bottom face with a rib 28 in which the associated side flange of the movable part 13 can slide. When the auxiliary part 16 is in its second, up, position, urged by the torsion spring 15, the part 27 limits the rotation of the part 13 so that the rotation pins 22 cannot escape from the circular spaces 26 of the corresponding guide elements 24.

The trip device preferably comprises a single auxiliary part 16, although the assembly may be symmetrical. For ease of fitting of the assembly, the movable part 13 can comprise a stop pin 29 (FIGS. 4 and 5), on the flange 23 opposite the one which cooperates with the auxiliary part 16, designed to operate in conjunction with a rib 30 of the internal face of the associated wall of the case (FIG. 3). The stop pin 29 thus enables the movable part 13 to be held inside the case 1, even in the absence of the auxiliary part 16, for example before fitting of the latter. The respective dimensions of the various components, a certain flexibility of the flanges 23 and of the auxiliary part 13, made of thermoplastic material, and the increasing cross-section of the stop pin 21, enable the movable part 13 and the auxiliary part 16 to be fitted, and removed if required, despite the presence of the stop pins 29 and 21.

Figure 5:
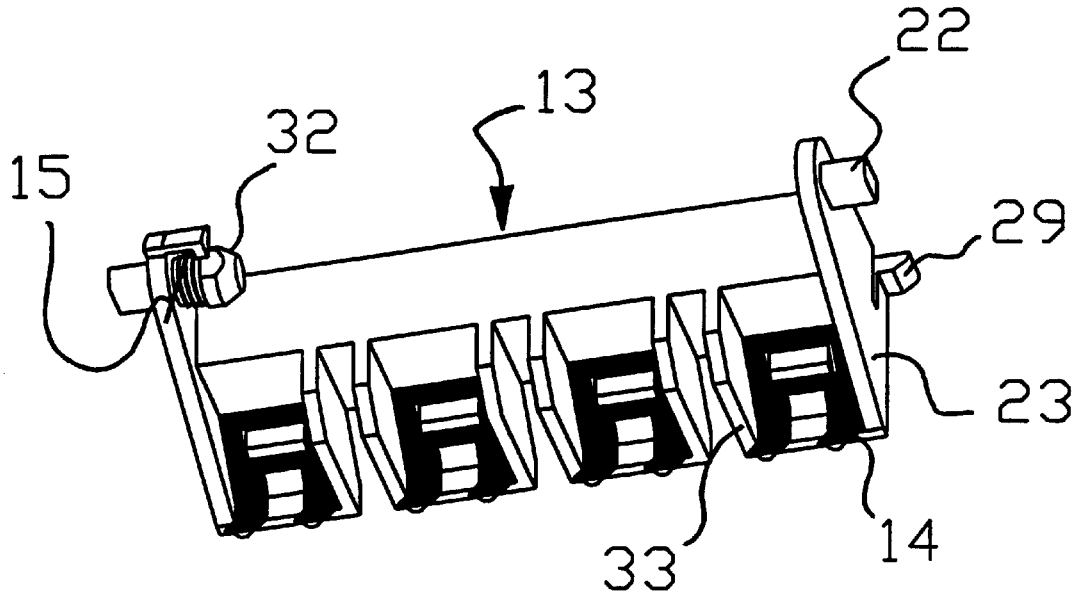
Figure 6:
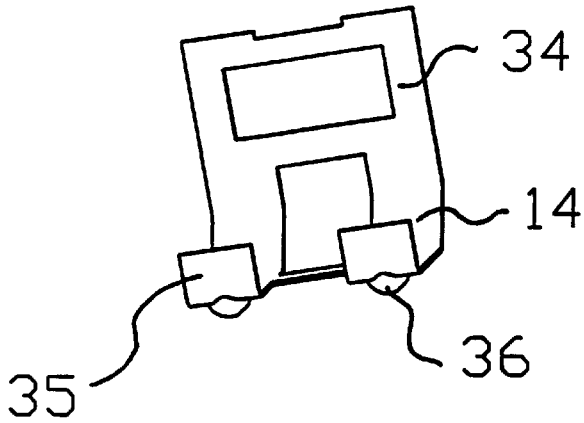
FIGS. 6 and 7 respectively represent a contact and a spring of the movable part according to FIGS. 4 and 5.

The torsion spring 15 comprises a central part and two ends. A first, free, end is designed to bear on a rib 31 arranged in the bottom of the case 1 (FIG. 3). The central part of the torsion spring is mounted on a pin 32, arranged in the extension of one of the rotation pins 22, i.e. protruding inwards with respect to the corresponding side flange 23 of the movable part 13 (FIGS. 4 and 5). The torsion spring is pre-positioned on the movable part by suitable securing elements.

Figure 15:
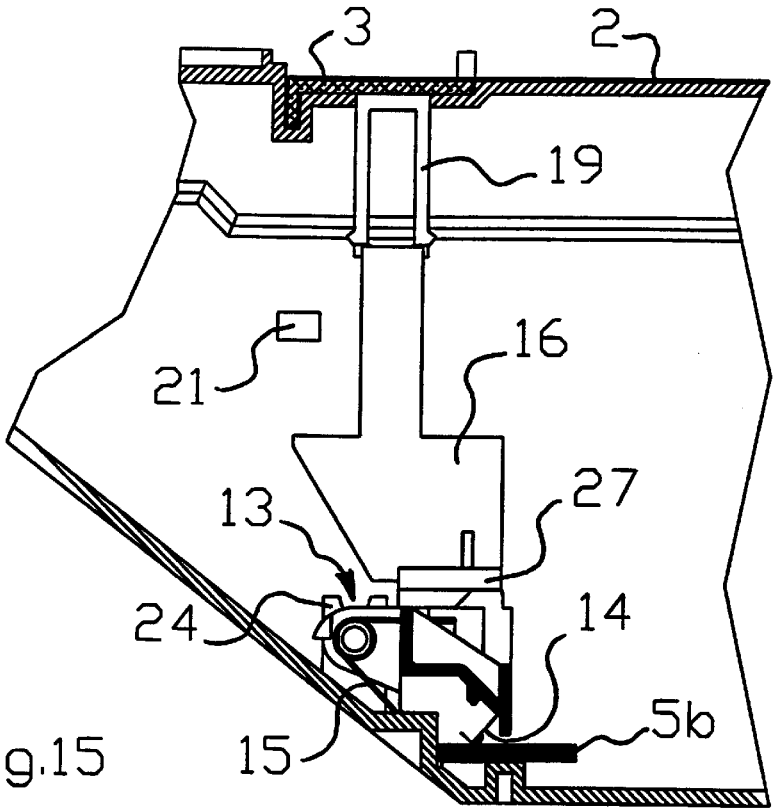
FIGS. 15 and 16 represent, in cross-section at the level of a contact of the movable part, the position of the different elements in a trip device according to FIG. 1, respectively in the fixed position and in an unlocked position of the removable module.
Figure 16:
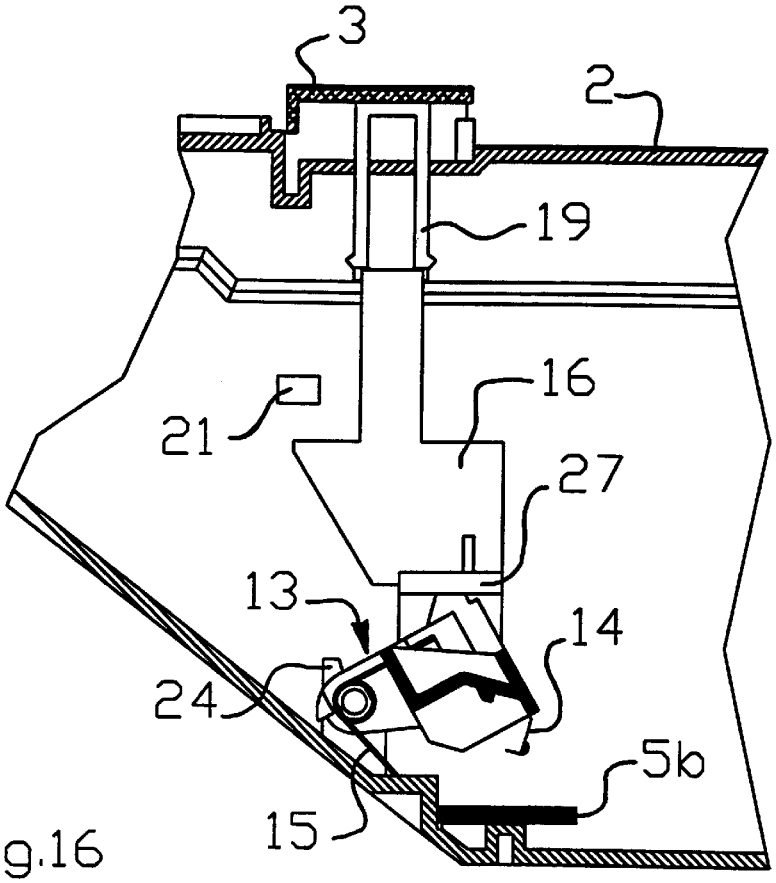

In the particular embodiment represented in FIG. 5, the movable part 13 bears four identical flexible contacts 14 designed to be associated to each of the phase conductors and to the neutral conductor of a three-phase power system with neutral 11. The contacts 14 are mounted on the movable part 13 either by heat welding or by clipping. They are fitted on the bottom part of the part 13 in locations bounded by protective side walls 33. Each contact 14 comprises a fixing zone 34 and is terminated by two separate, flexible, contact zones 35 respectively designed to come into contact with the contact points 8 and 9. To improve the contact, each contact zone preferably comprises, at its bottom part, a slight boss 36 which can be obtained by stamping. FIGS. 15 and 16 represent in cross-section the respective positions of the removable module 3, the auxiliary part 16, the movable part 13 and its contacts 14, and also of the printed circuit board 5*b*. In the fixed position of the removable module 3 (FIG. 15), the contacts 14 are in contact with the printed circuit board 5*b* which is arranged between the bottom of the case and the movable part 13. In the unlocked position of the removable module 3 (FIG. 16), the torsion spring 15 urges the movable part 13 and its contacts 14 to the disconnected position.

A particular embodiment of the removable module 3 is represented in FIGS. 11 to 14. Its lateral lugs 19 comprise retaining latches 37 at their free ends enabling the module to be held securedly to the front panel 2 of the case in an unlocked position. The lateral lugs 19, arranged in pairs on each side of the module 3, pass through corresponding orifices 38 of the front panel 2 (FIG. 1). They have a certain flexibility, which enables them to be inserted in the corresponding orifice 38, by moving the two lateral lugs of each pair towards one another. Once the removable module 3 has been fitted, it is fixed onto the front panel by means of a screw 39 (FIG. 12) which is screwed into a complementary threaded hole 40 formed in the front panel of the trip device (FIG. 1). The screw 39 is preferably of the captive type, secured to the removable module 3 in translation according to the axis of the screw. In this way, unscrewing the screw, through a hole 41 formed in the external face of the removable module 3, automatically results in the removable module 3 being lifted with respect to the front panel 2 of the trip device and unlocked, and consequently in the movable part 13 being moved to the disconnected position.

The external face of the removable module comprises, in conventional manner, holes 42 for selector switches or setting potentiometers to pass through. These holes 42 are aligned with holes 43 of the front panel of the trip device. The selector switches or setting potentiometers, forming part of the processing circuit, are supported by the printed circuit 5. The flexibility of the lugs 19 also enables the removable module 3 to be fully extracted in spite of the securing latches 37.

Figure 13:
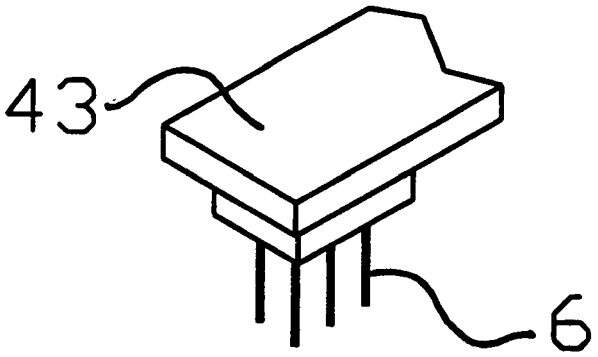
FIGS. 13 and 14 represent a particular embodiment of various elements of the removable module.
Figure 14:
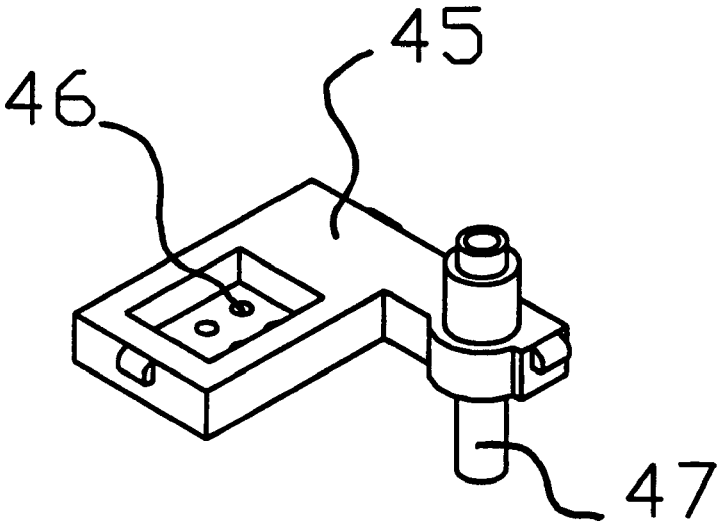

The removable module 3 comprises a printed circuit 43, represented in side view in FIG. 13. The printed circuit 43, bearing the contacts 6 of the removable module, is disposed inside a suitable housing 44 provided in the bottom part of the removable module. The printed circuit 43 is kept in place in the housing 44 by a cover 45 (FIG. 14) which clips into the housing. The cover 45 comprises holes 46 for the contacts 66 to pass. Moreover, the cover 45 bears a light guide 47. When the removable module 3 is in the fixed position, one end of the light guide comes into contact with an alarm light-emitting diode (LED 49, FIG. 2) of the processing circuit 4, mounted on the printed circuit 5. The alarm diode 49 is illuminated, for example, when the long delay tripping threshold is reached. The corresponding luminous information is transmitted directly by the light guide 47 to a corresponding hole 48 formed on the external face of the removable module (FIG. 11), thus constituting a luminous indicator.

FIG. 2 schematizes the electrical connections between the printed circuit 5 and the printed circuit 43 of the removable module 3. In the particular embodiment represented in FIG. 2, the printed circuit 43 is connected to five terminals 7 of the processing circuit 4 by contacts 6. A first terminal 7 is connected to a point common to four conductors formed on the printed circuit and respectively connected to the other four terminals 7. Each of the conductors can be interrupted, the number and arrangement of the integrated conductors corresponding to a 4-bit encoding of the value of the long delay parameter associated to the selected module.

Figure 17:
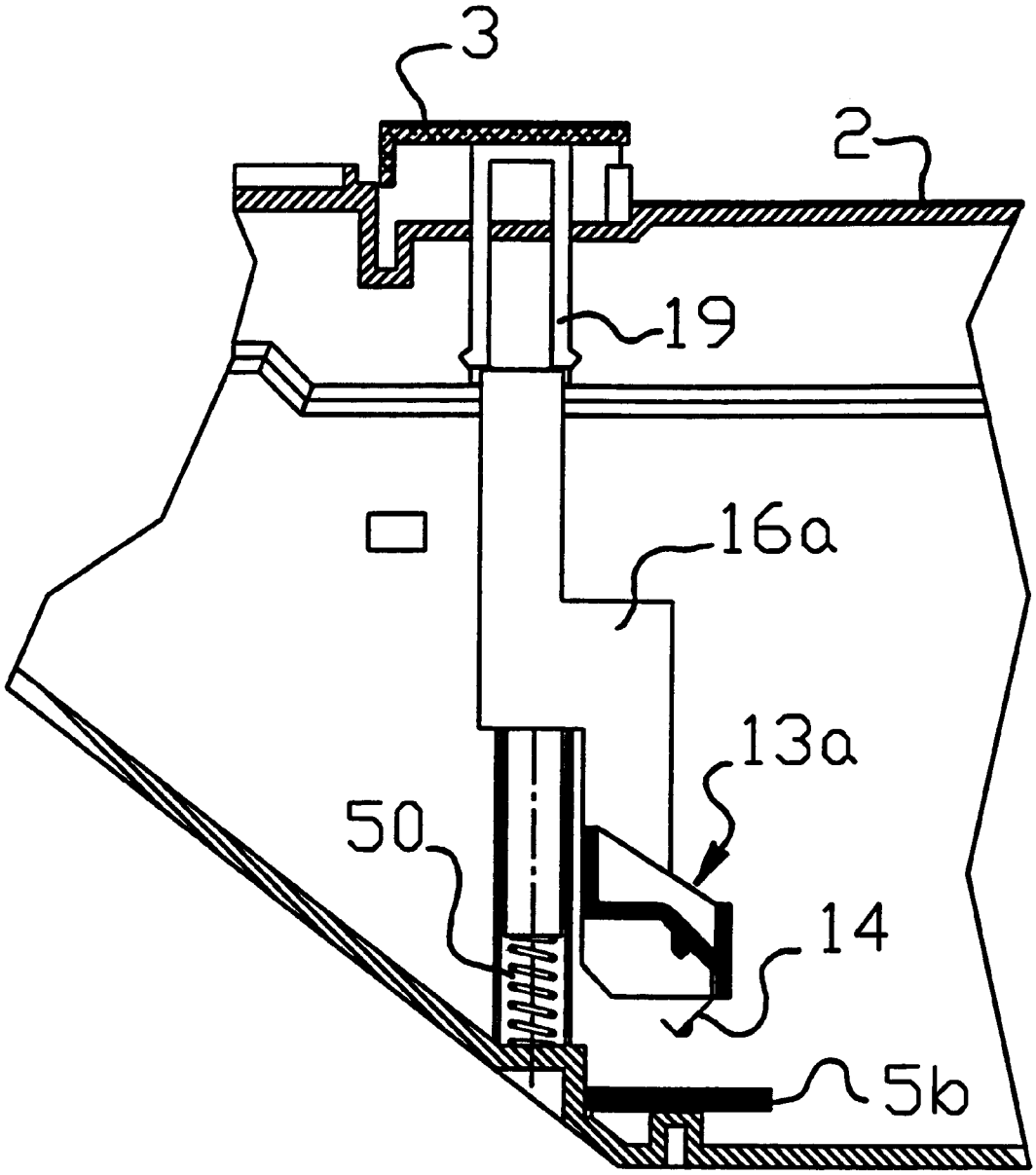
FIG. 17 represents an alternative version of FIG. 16 in which the movable part is movable in translation.

As an alternative embodiment, the part 13 can be replaced by a part 13*a* movable in translation in the case (FIG. 17). The auxiliary part is then formed by a part 16*a* securedly affixed to the movable part 13*a*. In the particular embodiment represented in FIG. 17, the spring means designed to urge the removable module 13*a* to the disconnected position are formed by a spring 50, guided in suitable elements of the case, and bearing on the one hand on the bottom of the case 1 and on the other hand on an edge of the auxiliary part 16*a*. In the fixed position of the removable module 3 on the front panel of the trip device, the module pushes the auxiliary part 16*a*, and the movable part 13*a*, towards the bottom of the case, against the action of the spring 50 which is then compressed. The contacts 14 then come into contact with the printed circuit 5*b*. As soon as the removable module 3 is in an unlocked position on the other hand, as represented in FIG. 17, the spring 50 pushes the intermediate part 16 upwards, this intermediate part driving the movable part 13*a* and interrupting the contact between the contacts 14 and the printed circuit 5*b*.

In all cases, unlocking of the removable module 3 is accompanied by automatic disconnection of the voltage inputs of the processing circuit. Interruption of the voltage connection, notably to carry out dielectric tests, is achieved simply, by unlocking the removable module 3, without any risk of the user accessing the live conductors (220 V) from the front panel, unlike what used to happen in known devices. The assembly according to the invention thus advantageously groups two functions, i.e. long delay calibration and voltage measurement disconnection.

In the embodiment represented in FIG. 1, the printed circuit 5 is made up of three parts and, in the disconnected position, the power system voltage is only present at the lower input of the connector 10, on the contact points 8 and in the conductors of the printed circuit board 5*c* forming the link between the connector 10 and the contact points 8. All these locations are located at a distance from the front panel 2 of the circuit breaker and, in addition, their access is protected by the presence of the front panel and, if this panel is removed, by the fact that the connecting conductors between the connector 10 and the contact points 8 are preferably formed on the face of the printed circuit board 5*c* arranged facing inwards, between the printed circuit boards 5*a* and 5*b*.

According to an alternative embodiment, an additional printed circuit board can be arranged between the front panel 2 and the printed circuit board 5*a*. This further limits the risks of access to the live parts. In this case the contact points 7, light-emitting diode 49, setting potentiometers or selector switches, are situated on the additional printed circuit board, or a suitable passage is provided in this board.

What is claimed is:

1. An electronic trip device comprising:

a case;

an electronic processing circuit located inside the case;

means for determining tripping parameters said means comprising a removable module;

means for fixing the removable module in a fixed position on a front panel of the case, whereby the removable module comes into contact with the processing circuit; and means having a connected position and a disconnected position, for connecting or disconnecting the processing circuit to power system conductors of a power system to be protected, said means for connecting or disconnecting comprising a movable part located inside the case and comprising flexible contacts which, in the connected position, form a contact between first contact points of a printed circuit, connected to the power system conductors, and second contact points of the printed circuit forming voltage inputs of the processing circuit, the means for connecting and disconnecting further comprising spring means urging the movable part to the disconnected position, the removable module, in the fixed position, urging the movable part to the connected position against the action of the spring means.

2. The trip device according to claim 1, wherein said movable part is movable in rotation with respect to the case.

3. The trip device according to claim 2, wherein the movable part comprises rotation pins having an end having a rectangular cross-section, internal faces of side walls of the case comprising associated guide elements each bounding a narrow rectangular passage and a circular space.

4. The trip device according to claim 2, wherein the movable part comprises a pin for fixing of a torsion spring constituting the flexible means.

5. The trip device according to claim 1, wherein said movable part is movable in translation with respect to the case.

6. The trip device according to claim 1, wherein the case comprises a guide rib on an internal face of at least one side wall of the case, the removable module comprising lateral lugs coming into contact with one end of an auxiliary part guided by the guide rib and inserted between the removable module and the movable part.

7. The trip device according to claim 1, wherein the removable module comprises securing latches designed to keep the module securedly affixed to the front panel in an unlocked position.

8. The trip device according to claim 1, wherein the processing circuit comprises a first printed circuit board, located in the case nearest to a front panel and comprising terminals designed to come into contact with associated contacts of the removable module, and a second printed circuit board, located in a posterior position with respect to the front panel and comprising first and second contact points, the movable part being interposed between the second printed circuit board and the front panel.

9. The trip device according to claim 1, wherein the removable module comprises a light guide coming into contact with an alarm light-emitting diode of the processing circuit when the removable module is in the fixed position.

* * * * *